US008979241B2

(12) United States Patent
Nystrom et al.

(10) Patent No.: US 8,979,241 B2
(45) Date of Patent: Mar. 17, 2015

(54) USING SATURATED MESH TO CONTROL ADHESIVE BOND LINE QUALITY

(75) Inventors: Peter J. Nystrom, Webster, NY (US); Yanjia Zuo, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 75 days.

(21) Appl. No.: 13/404,426

(22) Filed: Feb. 24, 2012

(65) Prior Publication Data

US 2013/0222486 A1 Aug. 29, 2013

(51) Int. Cl.
*B41J 2/015* (2006.01)
*B41J 2/16* (2006.01)

(52) U.S. Cl.
CPC ..... *B41J 2/1623* (2013.01); *B41J 2/161* (2013.01)
USPC ..... 347/20

(58) Field of Classification Search
None
See application file for complete search history.

(56) References Cited

U.S. PATENT DOCUMENTS

| | | | | |
|---|---|---|---|---|
| 4,864,329 | A * | 9/1989 | Kneezel et al. | 347/93 |
| 5,841,456 | A * | 11/1998 | Takei et al. | 347/103 |
| 2003/0076386 | A1* | 4/2003 | Tamahashi et al. | 347/71 |
| 2009/0225142 | A1* | 9/2009 | Kamikura | 347/92 |

* cited by examiner

*Primary Examiner* — Matthew Luu
*Assistant Examiner* — Erica Lin
(74) *Attorney, Agent, or Firm* — MH2 Technology Law Group LLP

(57) ABSTRACT

In some aspects of the present application, a printhead assembly is disclosed that comprise a plurality of functional plates stacked together; an adhesive confinement structure comprising an adhesive-coated mesh substrate arranged between adjacent functional plates to provide bonding between the plates.

8 Claims, 4 Drawing Sheets

USING SATURATED MESH TO CONTROL ADHESIVE BOND LINE QUALITY

FIELD OF THE DISCLOSURE

The present application is directed to printhead assemblies and in particular to a device and method for controlling moisture within portions of printhead assemblies.

BACKGROUND

Solid ink jet printing machines include printheads that include one or more ink-filled channels communicating at one end with an ink supply chamber or reservoir and having an orifice at the opposite end, commonly referred to as the nozzle. An energy generator, such as a piezo-electric transducer, is located within the channels near the nozzle to produce pressure pulses. Another type system, known as thermal ink jet or bubble jet, produces high velocity droplets by way of a heat generating resistor near the nozzle. Printing signals representing digital information originate an electric current pulse in a resistive layer within each ink passageway near the orifice or nozzle, causing the ink in the immediate vicinity to evaporate almost instantaneously and create a bubble.

Ink jet printheads typically require multiple layers of materials as part of their fabrication. Traditional methods use layers of gold plated stainless steel sheet metal with photo chemically etched features which are brazed together to form robust structures. However, with the continued drive to improve cost and performance, use of alternate materials and bonding processes are required. Polymer layers can replace certain sheet metal components and can be used to lower the cost of solid ink printheads, but most of these polymers do not work well with UV ink, which can degrade these materials or interfaces. What is needed is an improved printhead design that overcomes the problems with the conventional designs.

SUMMARY OF THE DISCLOSURE

In accordance with some aspects of the present disclosure, a printhead assembly is disclosed. The printhead assembly can include a plurality of functional plates stacked together; an adhesive confinement structure comprising an adhesive-coated mesh substrate arranged between adjacent functional plates to provide bonding between the plates.

In some aspects, the adhesive confinement structure can have a length about 102 mm and a width of about 37 mm. In some aspects, the adhesive confinement structure can include a plurality of openings having a length about 70 mm and a width about 4 mm, wherein the plurality of openings are spaced apart between about 1 mm and about 2 mm. In some aspects, the adhesive confinement structure can include a plurality of opening, wherein each opening has a size between about 25 μm and about 700 μm and is spaced between about 300 μm and about 600 μm apart. In some aspects, the plurality of openings can have a size between about 5 μm and about 25 μm. In some aspects, the adhesive confinement structure can have a length between about 100 and 325 mm and a width between about 10 and about 50 mm.

In some aspects, the adhesive can include a thermoplastic polyimide, a crosslinkable acrylic adhesive, an epoxy, and/or a thermoplastic polyimide. In some aspects, the functional plates can be formed of a metal, ceramic, and/or plastic material.

In accordance with some aspects of the present disclosure, a method for fabricating a printhead assembly in which the printhead includes a plurality of functional plates stacked together is disclosed. The method can comprise applying an adhesive to an adhesive confinement structure; arranging the adhesive confinement structure between adjacent functional plates; and forming the printhead assembly with the bonded functional plates.

It is to be understood that both the foregoing general description and the following detailed description are exemplary and explanatory only and are not restrictive of the disclosure, as claimed.

The accompanying drawings, which are incorporated in and constitute a part of this specification, illustrate several embodiments of the disclosure and, together with the description, serve to explain the principles of the disclosure.

DESCRIPTION OF THE EMBODIMENTS

Reference will now be made in detail to various exemplary embodiments of the present application, examples of which are illustrated in the accompanying drawings. Wherever possible, the same reference numbers will be used throughout the drawings to refer to the same or like parts.

In general, aspects of the present disclosure include using patterned materials, such as laser patterned or die-cut mesh/fabric films impregnated with liquid epoxy or adhesives, to enable compatibility with a wide range of ink types and control squeeze-out. The pattern/mesh/fabric materials assist in the control of squeeze-out and compatibility with ultraviolet (UV) curable and other inks. Adhesives and/or epoxies that have excellent chemical resistance, but which are not easily made into films, can be used in the fabrication of print head laminates with intricate fluid passages. By taking a material similar to a woven mesh of polyester fiber, possibly precut into net shape, saturating it with a liquid adhesive material, and applying it between layers of a print head, a robust bond can be formed. This mesh can limit the squeeze out of material by preventing the capture layers from fully extruding the liquid material from the joint. The parts can be fixtured/clamped and cured by whatever the recommended schedule for the material might be.

Figure 1:
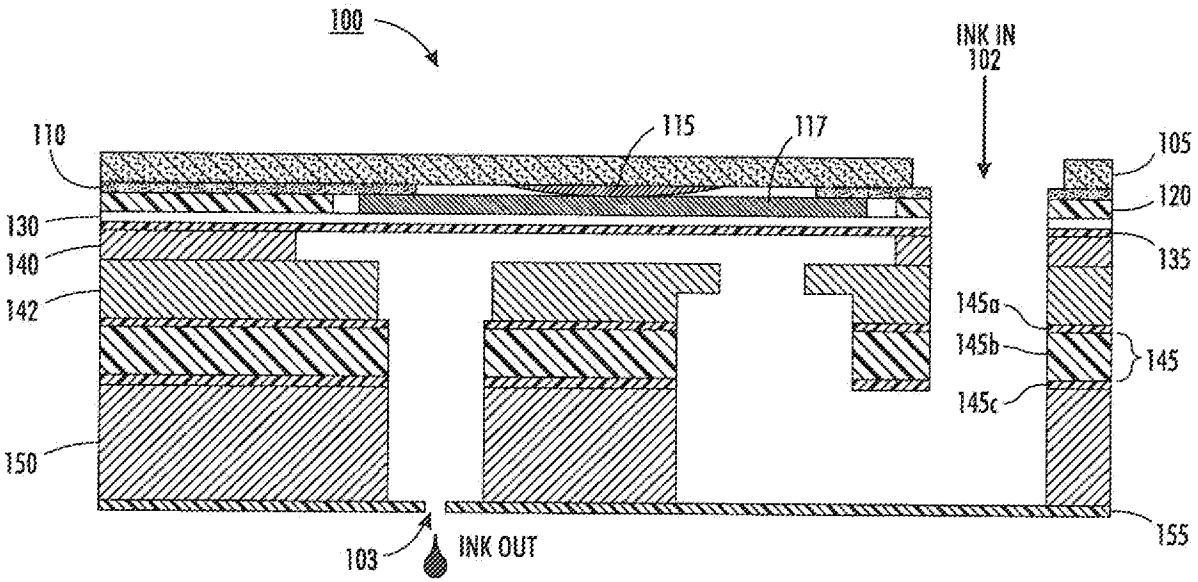
FIG. 1 shows an example cross-sectional view of printhead assembly for inkjet printing machines in accordance with aspects of the present disclosure.

FIG. 1 shows an example cross-sectional view of printhead assembly 100 for inkjet printing machines. Assembly 100 can comprise a series of functional plates, each performing an ascribed function for controlled dispensing of the molten ink onto a substrate passing by the assembly. In a particular embodiment, the printhead assembly 100 can comprise an ink flow inlet path 102 and an ink flow outlet path 103 that passes through layers of stackup comprising (layers from top to bottom in the figure) flexible circuit layer 105 (about 0.003" in thickness) composed of a flex circuit material, layer comprising Standoff layer 110 (about 0.001" in thickness) composed of a flexible, thermoset adhesive and a flexible, electrically conductive epoxy 115, layer comprising Spacer layer 120 (about 0.002" in thickness) composed of a polyimide material and piezoelectric material 117, diaphragm layer 130

(about 0.0008" in thickness) composed of stainless steel, Diaphragm Adhesive layer 135 (about 0.001" in thickness) composed of polyimide base films include, for example, thermoplastic polyimide film ELJ from DuPont, body layer 140 (about 0.003" in thickness) composed of stainless steel, Body Outlet A 142 (about 0.006" in thickness) composed of stainless steel, Body Outlet B 150 (about 0.010" in thickness) composed of stainless steel, polymer layer 145 comprising adhesive ELJ layer 145*a* manufactured by DuPont, polyimide layer 145*b*, and adhesive ELJ layer 145*c* manufactured by DuPont, stainless steel layer 150 (about 0.010" in thickness), and aperture layer 155 (about 0.001" in thickness) composed of a polyimide material. To bond any combination of stainless, aluminum or polyimide layers requires a thin film adhesive, such as ELJ, which is a commercially available thermoset polyimide film from DuPont Corporation or a flexible, thermoset adhesive. Each adhesive and/or epoxy layer of the printhead assembly 100 can include the confinement structure discussed below and shown in FIGS. 2 and 3.

Figure 2:
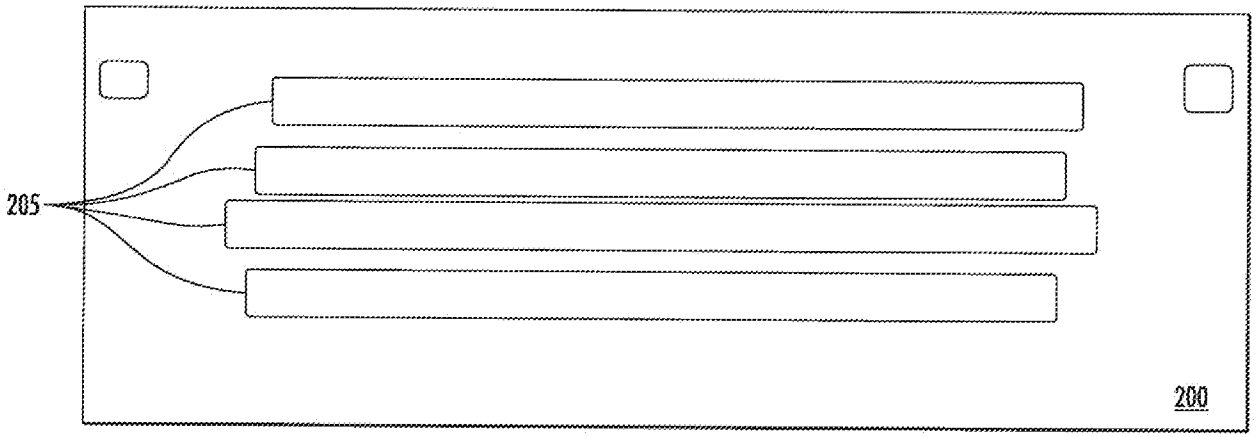
FIG. 2 shows an example adhesive confinement structure in accordance with aspects of the present disclosure.
Figure 3:
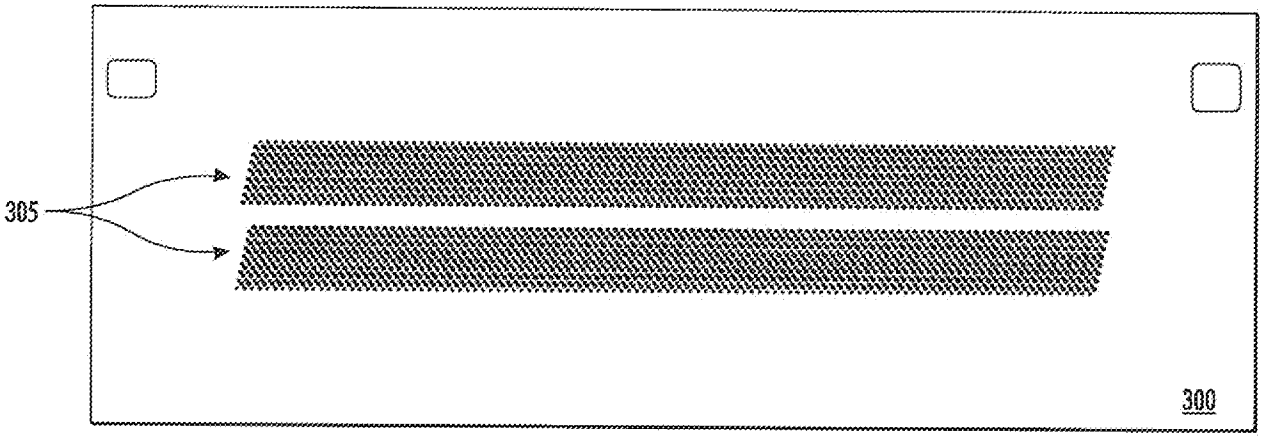
FIG. 3 shows another example adhesive confinement structure in accordance with aspects of the present disclosure.

FIGS. 2 and 3 show example adhesive confinement structures in accordance with aspects of the present disclosure. In both figures, the overall size of the structure can have a length of about 102 mm and a width of about 37 mm. In particular, FIG. 2 shows the adhesive confinement structure 200 that can be used with larger geometries. The adhesive confinement structure includes a plurality of openings 205 having a length about 70 mm and a width about 4 mm. The plurality of openings 205 can be spaced apart between about 1 mm and about 2 mm. FIG. 3 shows the confinement structure 300 that can be used with smaller geometry, such that the holes 305 can be about 50-200 μm in size with spacings that range from about 300 to about 600 μm pitch. In some aspects, the fine features can be as small as about 25 μm or less to as big as about 600 or about 700 μm.

The adhesive can include R1500, DuPont ELJ, Hitachi KS6600 or other similar materials and be of a thickness of about 1 mil thick. These materials tend to have good chemical resistance and yield strong bonds that are suitable for printhead design, especially those using UV inks. Also, these materials are suitable to be patterned by a laser or similar method and hold tight tolerance with respect to small features and passages cut within the final part.

The adhesive confinement structure can be composed of synthetic material that can be cut using conventional technologies. For example, ARLON manufactures polyimide circuit board laminates and prepreg (85NT) with Aramid fibers for laser drilled micro-via printed circuit boards. The mesh-like adhesive confinement structure can be applied, coated, and/or saturated with the adhesive by a variety of techniques including, for example, dipping, rolling and/or dispensing the adhesive onto the confinement structure. For example by rolling the adhesive onto the adhesive confinement structure, excess adhesive can be squeezed out. By choosing an appropriate thickness, the final bond line thickness can be controlled directly. Other material could be chosen for the adhesive confinement structure depending on the final properties desired—e.g. metal mesh or screen, nylon, cellulose, etc.

In some aspects, a prepreg type material can be formed directly by applying the adhesive/epoxy to the cloth material and B-staging the adhesive or drying it. The same advantages would apply (controlled squeeze out) but the material could be handled as other film stock currently is.

Figure 4:
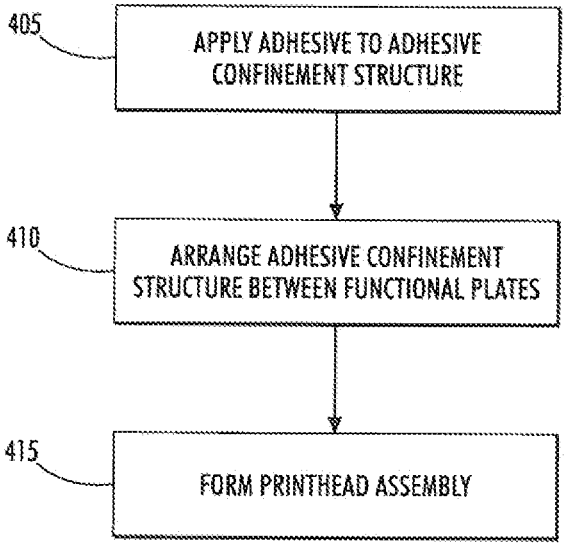
FIG. 4 shows an example method for forming the printhead assembly in accordance with aspects of the present disclosure.

FIG. 4 shows an example flow chart for forming a printhead assembly in accordance with aspects of the present disclosure. At 405, the method beings by applying an adhesive to an adhesive confinement structure. At 410, the method continues by arranging the adhesive confinement structure between adjacent functional plates. At 415, the method concludes by forming the printhead assembly with the bonded functional plates.

For the purposes of this specification and appended claims, unless otherwise indicated, all numbers expressing quantities, percentages or proportions, and other numerical Values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

It is noted that, as used in this specification and the appended claims, the singular forms "a," "an," and "the," include plural referents unless expressly and unequivocally limited to one referent. Thus, for example, reference to "an acid" includes two or more different acids. As used herein, the term "include" and its grammatical variants are intended to be non-limiting, such that recitation of items in a list is not to the exclusion of other like items that can be substituted or added to the listed items.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. A printhead assembly comprising:

a plurality of functional plates stacked together;

an adhesive confinement structure comprising an ultraviolet ink compatible adhesive and a mesh substrate that form an adhesive-coated mesh substrate arranged between adjacent functional plates to provide bonding between the plates and contain squeeze-out of the ultraviolet ink compatible adhesive from edges of the plurality of functional plates, wherein the ultraviolet ink compatible adhesive is operable to maintain an adhesive property when subjected to ultraviolet ink, wherein the mesh substrate comprises at least one of a cellulose, a natural fiber-like material, and combinations thereof.

2. The printhead assembly of claim 1, wherein the adhesive confinement structure has a length between about 100 mm and 325 mm and a width between about 10 mm and about 50 mm.

3. The printhead assembly of claim 1, wherein the adhesive confinement structure includes a plurality of openings having a length about 70 mm and a width about 4 mm, wherein the plurality of openings are spaced apart between about 1 mm and about 2 mm.

4. The printhead assembly of claim 1, wherein the adhesive confinement structure includes a plurality of openings, wherein each opening has a size between about 25 μm and about 700 μm and is spaced between about 300 μm and about 600 μm apart.

5. The printhead assembly of claim 1, wherein the adhesive confinement structure includes a plurality of openings, wherein each opening has a size between about 5 μm and about 25 μm.

6. The printhead assembly of claim 1, wherein the ultraviolet ink compatible adhesive includes a polymer, a thermoplastic polyimide, a crosslinkable acrylic adhesive, an epoxy, or a thermoplastic polyimide.

7. The printhead assembly of claim 1, wherein the plurality of functional plates comprise a first functional plate formed from one of a metal, ceramic, or plastic material and a second function plate formed from a different one of a metal, ceramic, or plastic material.

8. The printhead assembly of claim 1, wherein the mesh substrate is a metal mesh.

* * * * *